US005221359A

United States Patent [19]

Kaupert

[11] Patent Number: 5,221,359

[45] Date of Patent: Jun. 22, 1993

[54] WOOD BLEACHING AND CLEANING COMPOSITION CONTAINING AN ACID PYROPHOSPHATE

[76] Inventor: Peter Kaupert, 39119 Deerhorn Rd., Springfield, Oreg. 97477

[21] Appl. No.: 865,192

[22] Filed: Apr. 8, 1992

[51] Int. Cl.[5] ..... B08B 1/00; B08B 3/08; C11D 3/065; C11D 3/20

[52] U.S. Cl. ..... 134/26; 134/42; 252/136; 252/142; 252/143; 252/DIG. 14; 427/368; 428/541

[58] Field of Search ..... 252/136, 142, 143; 134/26, 42; 428/541; 427/368

[56] References Cited

U.S. PATENT DOCUMENTS

| | | | |
|---|---|---|---|
| 2,878,188 | 3/1959 | Callahan | 252/136 |
| 2,990,374 | 6/1961 | Schwartz | 252/136 |
| 3,166,444 | 1/1965 | Ehren | 134/3 |
| 3,211,659 | 10/1965 | Pikaar | 252/136 |
| 3,832,234 | 8/1974 | Otrhalek | 134/4 |
| 4,007,124 | 2/1977 | Collier | 252/109 |
| 4,477,364 | 10/1984 | Garcia | 252/142 |
| 4,587,030 | 5/1986 | Casey | 252/92 |
| 4,734,138 | 3/1988 | Ely | 134/27 |
| 4,877,459 | 10/1989 | Cockrell | 134/40 |
| 5,039,441 | 8/1991 | Thomas | 252/142 |

*Primary Examiner*—Dennis Albrecht
*Attorney, Agent, or Firm*—Richard C. Litman

[57] ABSTRACT

Method and compositions for restoring the original color and texture to degraded wood surfaces comprising an aqueous solution of an alkali metal acid pyrophosphate and a surfactant. An organic acid having a relatively low coefficient of toxicity can be optionally incorporated into the wood treating compositions to enhance the cleaning capacity of the solution. The non-abrasive compositions are capable of removing embedded soil and stains from wood surfaces without altering the mechanical properties of the wood structure.

2 Claims, No Drawings

WOOD BLEACHING AND CLEANING COMPOSITION CONTAINING AN ACID PYROPHOSPHATE

BACKGROUND OF THE INVENTION

1. Field of the Invention

The present invention relates to a wood bleaching and cleaning composition and, more particular, to aqueous formulations containing non-hazardous components for restoring the original color to degraded wood surfaces.

2. Description of the Prior Art

The original color and texture of wood surfaces which are intended to present a esthetically natural appearance are often lost upon extended exposure to environmental conditions. After prolonged periods of exposure to ultraviolet light, moisture, pollution and temperature extremes, for example, surfaces of wood articles and constructions eventually deteriorate in coloration or become unsightly stained. Stains from other than exposure to long term weathering which may accumulate on the outer surface of wood structures are usually due to dirt, mold, mildew and tannin residues. In many instances, refinishing or restoration of these weathered and/or stained wood structures becomes the only viable option since the replacement costs involved would be economically prohibitive. However, commercial refinishing processes which include such abrasive cleaning techniques as sending the entire wood surface in order to remove the discolored area are costly and time-consuming operations. Of course, merely painting this damaged area by applying a pigmented film onto the wood surface does not result in a coating finish that remotely approaches the original wood appearance. Moreover, such paint coatings usually undergo severe discoloration under the influence of environmental exposure and the film coatings themselves are subject to cracking, followed by peeling and blistering in a relatively short period of time.

Efforts to improve the appearance of discolored wood surfaces have also included the use of a wide variety of bleaching and/or cleaning agents. For instance, chlorine-based chemicals such as chlorine, chlorine dioxide and hypochlorite have been used in the prior art to bring about a chemical bleaching of the wood fibers. However, these bleaching agents produce chlorides and chlorinated organic compounds which are highly toxic and have an undersirable impact on the environment. Moreover, such agents as chlorine dioxide are highly corrosive, explosive and require expert handling with highly specialized equipment to avoid serious injury to the handler.

It has been proposed to reduce or eliminate undesirable chlorinated compounds in wood bleaching processes by substituting non-chlorine bleaching agents such as peroxides, ozone, paracetic acid, oxalic acid, etc., for the chlorine-based bleaching chemicals. Unfortunately, no chlorine-free wood bleaching procedure has been efficiently developed which is capable of safely producing brightened wood surfaces without significantly degrading the wood's mechanical properties.

Another alternative that has been proposed or practiced in an effort to remove the discoloration of weathered or stained wood surfaces is to apply a nonabrasive, liquid cleaning composition. However, among the host of commercial and industrial liquid cleaners generally containing various combinations of surfactants and alkaline salts and/or acids, many of them have met with only varying degrees of success and none have proved to be safe and effective in removing discolored deposits on wood surfaces at an acceptable cost. For instance, U.S. Pat. No. 3,211,659 to Pikaar describes an aqueous solution of non-toxic acid such as citric acid, phosphoric acid and acetic acid, a buffering reagent and a wetting agent for the removal of various contaminants from the surface of shell eggs. While this prior art acid composition is relatively mild and safe, it clearly lacks sufficient strength to remove embedded soil and resistant stains on wood surfaces resulting from exposure to long term weathering.

SUMMARY OF THE INVENTION

It is accordingly a primary object of the present invention to provide a non-toxic composition capable of bleaching and/or cleaning wood surfaces which is safe, effective and economical to use.

It is a further object of the invention to provide a safe, non-toxic wood bleaching composition in the form of an aqueous solution having excellent cleaning properties and containing essentially harmless components from an environmental aspect.

It is among the additional objects of the present invention to provide nonabrasive, liquid wood bleaching and cleaning formulations for restoring the original color and texture to degraded wood surfaces without altering the mechanical properties of the wood. The present chemical formulations can be readily handled without any detrimental effects to the user or the environment, and are capable of preventing problems associated with strongly acidic or alkaline cleaning reagents such as high toxicity, flammability and excess corrosion.

These and other objects are accomplished in accordance with the present invention wherein an improved wood bleaching and cleaning composition in the form of an aqueous solution is provided comprising an alkali metal acid pyrophosphate and a surfactant in amounts effective for removing a soiled or stained area from wood surfaces. Optionally, a non-toxic organic acid component can be incorporated into the present composition to enhance its chemical effectiveness.

The exact mechanism of chemical action which is responsible for the removal of resistant soil and stains from wood surfaces when the relatively mild acidic solutions of the present invention are utilized for this purpose is not completely understood. However, it is known that the chemical activity of the present compositions is not based entirely on the principle of stain solubilization or solely on the bleaching and/or cleaning action of the alkali metal acid pyrophosphate component for removal of the discoloration. It is believed that the mildly acidic pyrophosphate in solution penetrates the soil or stain to aid detachment and then reacts with the lignocellulose for the wood wherein partial delignification occurs just below the surface of the wood. Thus, the removal of the undesirable surface discoloration may actually be accomplished by chemically etching away a minute layer of the wood surface itself. This etching effect on the wood surface does not significantly alter the overall mechanical properties of the wood structure, but is of sufficient magnitude to completely undercut and remove the deeply embedded stains.

The above description, as well as further objects, features and advantages of the present invention, will be more fully appreciated by reference to the following detailed description.

DETAILED DESCRIPTION OF THE INVENTION

Accordingly, the present invention provides a non-abrasive, composition for bleaching and/or cleaning wood to remove surface discoloration therefrom comprising effective amounts of an alkali metal acid pyrophosphate and a surfactant in an aqueous solution. The alkali metal acid pyrophosphate component is generally added in finely divided form as a solution in water to provide a suitable source of hydrogen ion to achieve the wood treatment results of the invention. This component possess sufficient acidity in solution to enable the acid to have an etching effect on the wood surface, yet is non-corrosive to other surfaces. Also, the acid pyrophosphate in solution is toxicologically safe from an environmental perspective as well as being biologically safe to both the user and the environment in general. The preferred pyrophosphate is sodium acid pyrophosphate, $Na_2H_2P_2O_7$, but the corresponding potassium derivative can also be utilized.

The amount of the aforementioned acid pyrophosphate component present in the aqueous solution is generally in the range of about 2% to about 10%, preferably about 3% to about 6%, although amounts outside this range would also be suitable. The strength of the concentration of the acid pyrophosphate in solution employed is substantially dependent on the type and degree of discoloration on the wood surface to be treated. Generally, the initial pH of the present solutions containing this acid component should range between about 1.5 and about 4. The solutions according to the present invention are capable of removing mold, mildew and tannin stains, dirt, and grey or discolored residues caused by weathering under relatively mild chemical treatment conditions which does not adversely effect the mechanical properties of the wood.

The surfactant which can be employed in accordance with the present invention in conjunction with the above described alkali metal acid pyrophosphate component includes an anionic, nonionic or amphoteric surfactant. The surfactant generally serves to increase the effectiveness of the present solutions and particularly functions to wet and disperse the soil or stain on the wood surface. Suitable surfactants are those which contain one or more hydrophobic organic radicals and water-solubilizing ionic or nonionic groups in the molecule. The hydrophobic radical is preferably an aliphatic hydrocarbon radical of from 8 to 26, preferably from 12 to 18, carbon atoms or an alkylaromatic radical having 6 to 28, preferably from 8 to 16, carbon atoms in the alkyl group. Suitable anionic surfactants are the sodium, potassium and ammonium salts of carboxylic acids, sulfonic acids and sulfuric monoesters having the stated number of carbon atoms.

Particularly suitable anionic surfactants include those of the sulfonate type and more particularly alkylaryl sulfonates having from 9 to 15 carbon atoms in the alkyl radical, alkene-and hydroxy-alkane sulfonates and disulfonates. Of these sulfonate type surfactants, sodium dodecylbenzene sulfonate and sodium dodecylnaphthalene sulfonate is preferred since these compounds are also biodegradable and, therefore, pose no threat to the environment upon disposal. However, besides these preferred anionic surfactants, amphoteric surfactants such as alkylbetaines or alkylsulfobetaines which in aqueous solution contain not only anionic but also cationic groups, and nonionic surfactants are also suitable for use in the aqueous wood cleaning solutions of the present invention. Representative of the suitable nonionic surfactants are the water-soluble addition products of ethylene oxide and alkylphenols, alkylene glycols, alkylenediaminepolypropylene glycols or alkylpolypropylene glycols, for example.

The amount of surfactant utilized in the aqueous wood treatment compositions of the invention may generally range from about 0.5% to about 2.5% by weight of solution, although amounts outside this range can also be effectively utilized. The upper limit on the amount of surfactant employed is usually govern by cost and the need to avoid excessive foam generation during the application procedure.

An optional component which can be incorporated into the present wood cleaning compositions is an organic or inorganic acid, preferably having a relatively low coefficient of toxicity. Exemplary low-toxic acids include citric acid, gluconic acid, acetic acid, tartaric acid, boric acid, malic acid, glycolic acid and benzoic acid, including mixtures of two or more such acids. Salts of these acids such as sodium diacetate and other acid salts such as sodium bisulfate and sodium bisulfite, which form the free acid in solution, can also be employed for purposes of the present invention. This optional acid component appears to function in conjunction with the acid pyrophosphate component to enhance the cleaning capacity of the present solutions. The amount of this optional component employed should not be such as to increase the initial pH of the present solutions substantially above pH 4 and is present in relatively minor proportions, as compared to the amount of the alkali metal acid pyrophosphate. Preferably, the amount of this optional acid in the present aqueous solutions generally ranges between about 0.5% and about 3% by weight of solution.

The compositions of the present invention having the desired concentrations and relative proportions of the above components are preferably formulated as an aqueous solution by dissolving the appropriate amounts of the alkali metal acid pyrophosphate, surfactant, and optional acid into water. Such ready to use compositions may be conveniently dispensed from suitable containers such as pump sprayers, trigger spray bottles, and the like. The present compositions may also be provided in other forms such as liquid concentrates and solid mixtures containing the designated components in the proper proportions. In such compositions, the amount of alkali metal acid pyrophosphate can vary from about 75% to about 95%; the amount of surfactant can range from about 5% to about 25%; and the auxiliary acid component can vary from in the range from 0% up to about 20%, based on the total weight of the components employed. Such concentrates and solid mixtures can be added to water in an amount ranging from about 5 to about 10 ounces per gallon of solution to form a working composition.

Wood surfaces can be cleaned according to the invention by spray application or soaking the surface of the wood to be treated with the present liquid compositions under ambient conditions. Preferably, the surface is then lightly scrubbed to facilitate detachment of soil or stains and to allow the working compositions of the invention to penetrate into the surface of the wood.

This treatment usually takes about 5 to 15 minutes, depending on the concentration of acid components in solution, and the treated wood surface is then rinsed with water.

The following specific examples is given to further illustrate the present invention. All relative proportions are set forth as percentages by weight unless otherwise specifically indicated.

EXAMPLE 1

A wood treating composition in the form of an aqueous solution is prepared according to the invention as described hereinabove by mixing the following components:

| COMPONENTS | WT. PERCENT |
|---|---|
| Sodium acid pyrophosphate ($Na_2H_2P_2O_7$) | 8.5 |
| Sodium dodecylbenzene sulfonate | 1.5 |
| Water | 90.0 |

The above composition was applied to one surface of a wood board which had become noticeably grey from extended exposure to environmental conditions. The other original surface of the wood showed no signs of discoloration. The treated board surface is then lightly scrubbed with a brush for about 10 minutes, and finally rinsed with water.

The board surface treated in the above manner was observed to be practically indistinguishable from the original board surface, having substantially all the grey discoloration removed and exhibiting the color and texture of the original wood surface.

EXAMPLE 2

A wood treating composition containing a mixture of auxiliary acids in the form of an aqueous solution is prepared according to the invention mixing the following components:

| COMPONENTS | WT. PERCENT |
|---|---|
| Sodium acid pyrophosphate ($NaH_2P_2O_7$) | 6.0 |

-continued

| COMPONENTS | WT. PERCENT |
|---|---|
| Sodium dodecylbenzene sulfonate | 1.0 |
| Citric acid | 1.5 |
| Tartaric acid | 1.5 |
| Water | 90.0 |

The above composition was applied to one surface of a wood board which was soiled with dirt and had become stained with mold and mildew. The board surface was treated in the above manner identical to that set forth in Example 1. The treated board surface was noticeably clean, with substantially all soils and stains removed, and exhibited the color and texture of the original wood surface.

It is contemplated that the compositions of this invention may also be used for bleaching wood fibers for the production of paper pulps.

It should be understood that there may be various changes and modifications of the representative embodiments herein chosen for purposes of illustration without departing from the spirit and scope of the invention. Accordingly, the foregoing illustrations are not to be interpreted as restrictive of the invention beyond that necessitated by the following claims.

I claim:

1. A method for removing mold and mildew stains from wood surfaces which comprises applying to said wood surfaces an aqueous composition consisting essentially of about 2% to about 10% by weight of an alkali metal acid pyrophosphate and about 0.5% to about 2.5% by weight of an anionic surfactant, followed by scrubbing and then rinsing the wood surface with water.

2. A method for removing mold and mildew stains from wood surfaces which comprises applying to said wood surfaces an aqueous composition consisting essentially of about 2% to about 10% by weight of an alkali metal acid pyrophosphate, about 0.5% to about 2.5% by weight of an anionic surfactant, and about 0.5% to about 3% by weight an acid selected from the group consisting of citric acid, gluconic acid, acetic acid, tartaric acid, boric acid, malic acid, glycolic acid, benzoic acid and mixtures thereof, followed by scrubbing and then rinsing the wood surface with water.

* * * * *